US007324657B2

(12) United States Patent
Kobayashi et al.

(10) Patent No.: US 7,324,657 B2
(45) Date of Patent: Jan. 29, 2008

(54) SPEAKER APPARATUS

(75) Inventors: Hiroyuki Kobayashi, Tendo (JP); Toshihiro Hikichi, Tendo (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 495 days.

(21) Appl. No.: 11/072,642

(22) Filed: Mar. 7, 2005

(65) Prior Publication Data

US 2005/0232450 A1 Oct. 20, 2005

(30) Foreign Application Priority Data

Mar. 8, 2004 (JP) ..... 2004-063474

(51) Int. Cl.
*H04R 25/00* (2006.01)

(52) U.S. Cl. ..... 381/386; 381/182; 381/401

(58) Field of Classification Search ..... 381/150, 381/162, 164, 182, 186, 172, 386, 398, 400, 381/401, 403, 407, 412, 414, 420; 362/86, 362/257; 181/171–172, 199
See application file for complete search history.

(56) References Cited

U.S. PATENT DOCUMENTS

| | | | | |
|---|---|---|---|---|
| 4,817,163 | A * | 3/1989 | Stastny | 381/150 |
| 6,563,929 | B2 * | 5/2003 | Kim | 381/117 |
| 6,978,031 | B2 * | 12/2005 | Garretson et al. | 381/162 |
| 7,123,738 | B1 * | 10/2006 | Mizone et al. | 381/406 |

FOREIGN PATENT DOCUMENTS

| | | |
|---|---|---|
| JP | 2000-261874 A | 9/2000 |
| JP | 2003-023693 A | 1/2003 |

* cited by examiner

*Primary Examiner*—Huyen Le
(74) *Attorney, Agent, or Firm*—Sughrue Mion, PLLC

(57) ABSTRACT

A voice coil and a magnetic driving circuit oscillate a diaphragm and a center cap. A magnetic lighting circuit for providing a magnetic field to an induction coil is mounted separately from a magnetic driving circuit. The induction coil generates an electromotive force for lighting light-emitting devices. Further, the light-emitting devices, the induction coil, and the magnetic lighting circuit are mounted integrally on the center cap.

6 Claims, 4 Drawing Sheets

SPEAKER APPARATUS

BACKGROUND OF THE INVENTION

The priority application Number Japanese Patent Application 2004-063474 upon which this patent application is based is hereby incorporated by reference.

1. Field of the Invention

This invention relates to a speaker apparatus, and more specifically to the speaker apparatus to be assembled easily, and of which coils generate high electromotive forces.

2. Description of the Related Art

Conventionally, a speaker apparatus having a light-emitting device in a visible position thereof, and the light-emitting device being lighted by a part of an input current for a voice coil are proposed for monitoring an input to the speaker apparatus. In such the speaker apparatus, a source for lighting the light-emitting device is supplied by a part of a voice-coil driving current, so that wiring between the light-emitting device and a feeder circuit for the voice coil is required.

FIG. 1 shows a half-sectional schematic view of a conventional speaker apparatus 9. The speaker apparatus 9 includes a magnetic circuit 10 having a cylindrical center pole 10*a*, a magnet 10*b*, and a yoke 10*c*. A magnetic gap 10*d* is formed in the magnetic circuit 10, and a voice coil 11 is inserted into the magnetic gap 10*d*. This voice coil 11 is wound around a coil bobbin 13 being supported movably in a vertical direction by a damper 12.

An inner periphery of a diaphragm 14 having a ring shape in a top view adheres to the coil bobbin 13. An outer periphery of the diaphragm 14 is fixed on a frame 19. A center cap 15 covers a center hole of the diaphragm 14. A coil bobbin 17 is formed integrally with a substrate on which a light-emitting device 16 is mounted. This coil bobbin 17 is attached to the center cap 15. An induction coil 18 is wound around the coil bobbin 17. Like the voice coil 11, the induction coil 18 is arranged in the magnetic gap 10*d*.

According to the above, when the input current for the voice coil 11 is displaced, the coil bobbin 17 oscillates up and down. Owing to the oscillation of the coil bobbin 17, the diaphragm 14 and the center cap 15 oscillate to generate a sound. Further, the oscillation of the center cap 15 oscillates the induction coil 18 in the magnetic gap 10*d*, and the oscillation of the induction coil 18 induces an induced electromotive force. If this induced electromotive force is used for a source for lighting the light-emitting device 16, wiring between the light-emitting device 16 and a feeder circuit (not shown) for the voice coil 11 is not required.

However, in the speaker apparatus 9 of FIG. 1, the induction coil 18 is also inserted into the magnetic gap 10*d* to which only the voice coil 11 is originally inserted. Therefore, the magnetic gap 10*d* is needed to be larger, and the magnetic gap 10*d* cannot provide a large magnetic field to the voice coil 11 and the induction coil 18. Therefore, oscillations of the diaphragm 14 and the center cap 15 corresponding to the input current supplied to the voice coil 11 become so small as not to output a sufficient sound. Further, a high electromotive force cannot be induced through the induction coil 18. In addition, when assembling the speaker apparatus 9 on a production line, it is necessary to insert the two coils, the voice coil 11 and the induction coil 18, into the magnetic gap 10*d*. Therefore, there is a problem that an assembly operation of the speaker apparatus 9 is complicated.

Japanese published unexamined patent application No. 2003-23693 discloses a speaker apparatus (not shown) having an induction coil positioned outside of a magnetic gap as long as an induction coil receives a magnetic field of the magnetic gap. However, in such the speaker apparatus, it is more difficult for the induction coil to generate a high electromotive force.

Japanese published unexamined patent application No. 2000-261874 discloses a speaker apparatus (not shown) having an induction coil as a secondary coil corresponding to a voice coil as a primary coil. The induction coil generates an electromotive force to light a light-emitting device caused by a displacement of an input current to the voice coil. However, in such the speaker apparatus, it is necessary for a voice coil to pass a high input current for gaining a high electromotive force generated by the induction coil. Therefore, there is a problem to gain a high electromotive force.

In short, each of these conventional speaker apparatuses described above has two coils, a voice coil and an induction coil, for the one magnetic circuit. Therefore, there is a problem that a high magnetic field cannot be provided to either of the voice coil and the induction coil, and an assembly operation on a speaker apparatus production line is complicated.

Accordingly, it is an object of this invention to provide a speaker apparatus which is easily assembled, and in which coils generate high electromotive forces.

SUMMARY OF THE INVENTION

In order to attain the object, according to the present invention, there is provided a speaker apparatus including:

an oscillation unit for generating a sound;

a drive unit having a voice coil and a magnetic driving circuit for providing a magnetic field to the voice coil to oscillate the oscillation unit;

light-emitting devices mounted at specific positions; and an electromotive force generator for lighting the light-emitting devices including an induction coil and a magnetic lighting circuit, the magnetic lighting circuit being mounted separately from the magnetic driving circuit for providing a magnetic field to the induction coil, whereby owing to an oscillation of the oscillation unit, the induction coil of the electromotive force generator generates an electromotive force for lighting the light-emitting devices.

Preferably, in the speaker apparatus described above, the induction coil and the magnetic lighting circuit are mounted on the oscillation unit.

Preferably, in the speaker apparatus described above, the induction coil and the magnetic lighting circuit are mounted on a center cap of the oscillation unit.

Preferably, in the speaker apparatus described above, the electromotive force generator further includes a damper for coupling either one of the induction coil or the magnetic lighting circuit to the oscillation unit movably relative to the oscillation unit, while the other one of the induction coil or the magnetic lighting circuit is fixed on the oscillation unit.

Preferably, in the speaker apparatus described above, the light-emitting devices are attached to a substrate on which the induction coil is mounted.

Preferably, in the speaker apparatus described above, the light-emitting devices are attached to the center cap of the oscillation unit.

The above and other objects, features, and advantages of this invention will be better understood when taken in connection with the accompanying drawings and description.

DESCRIPTION OF THE PREFERRED EMBODIMENTS

Embodiment of the Present Invention

Figure 1:
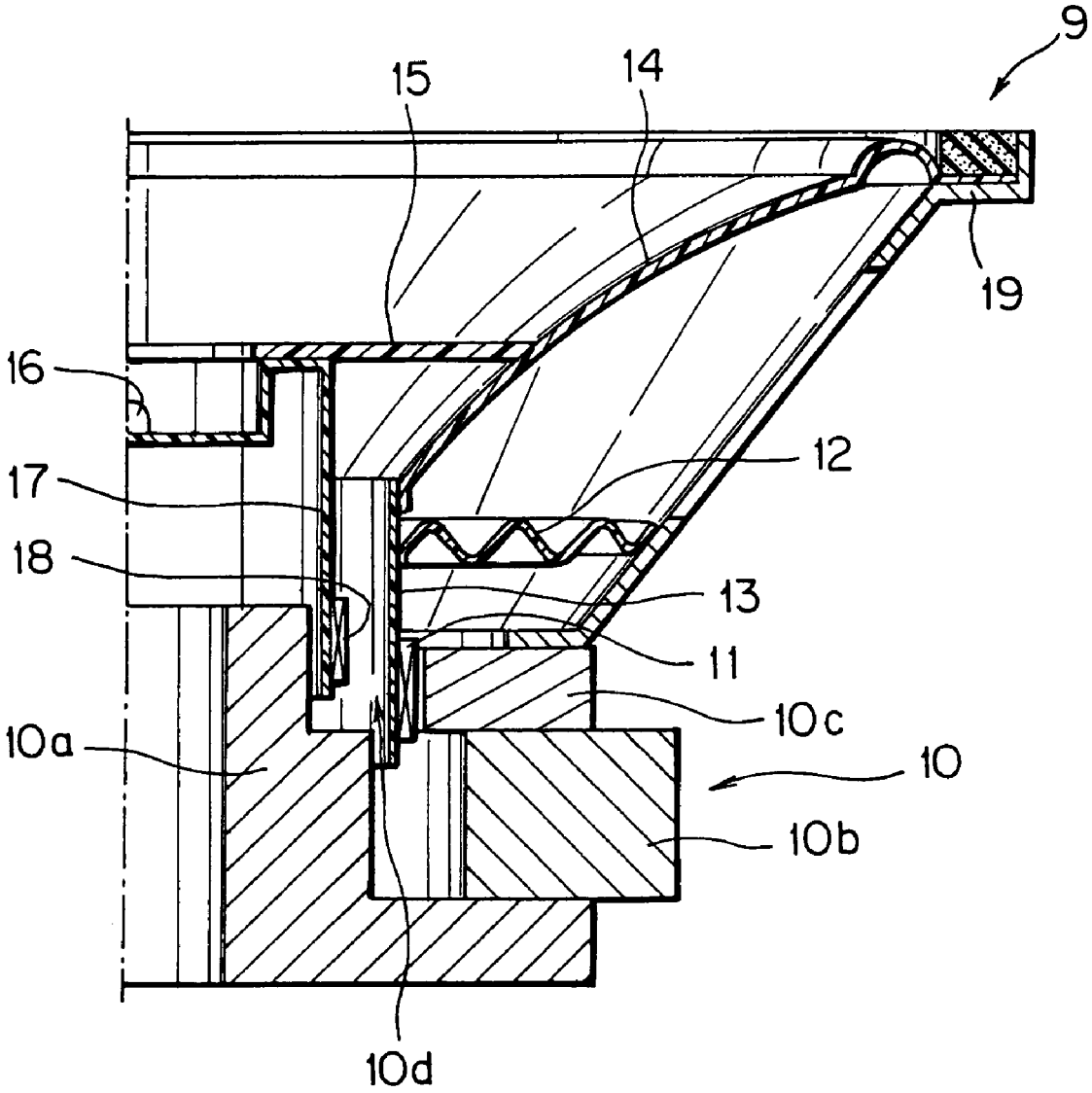
PRIOR ART FIG. 1
FIG. 1 is a half-sectional schematic view showing a conventional speaker apparatus.
Figure 2:
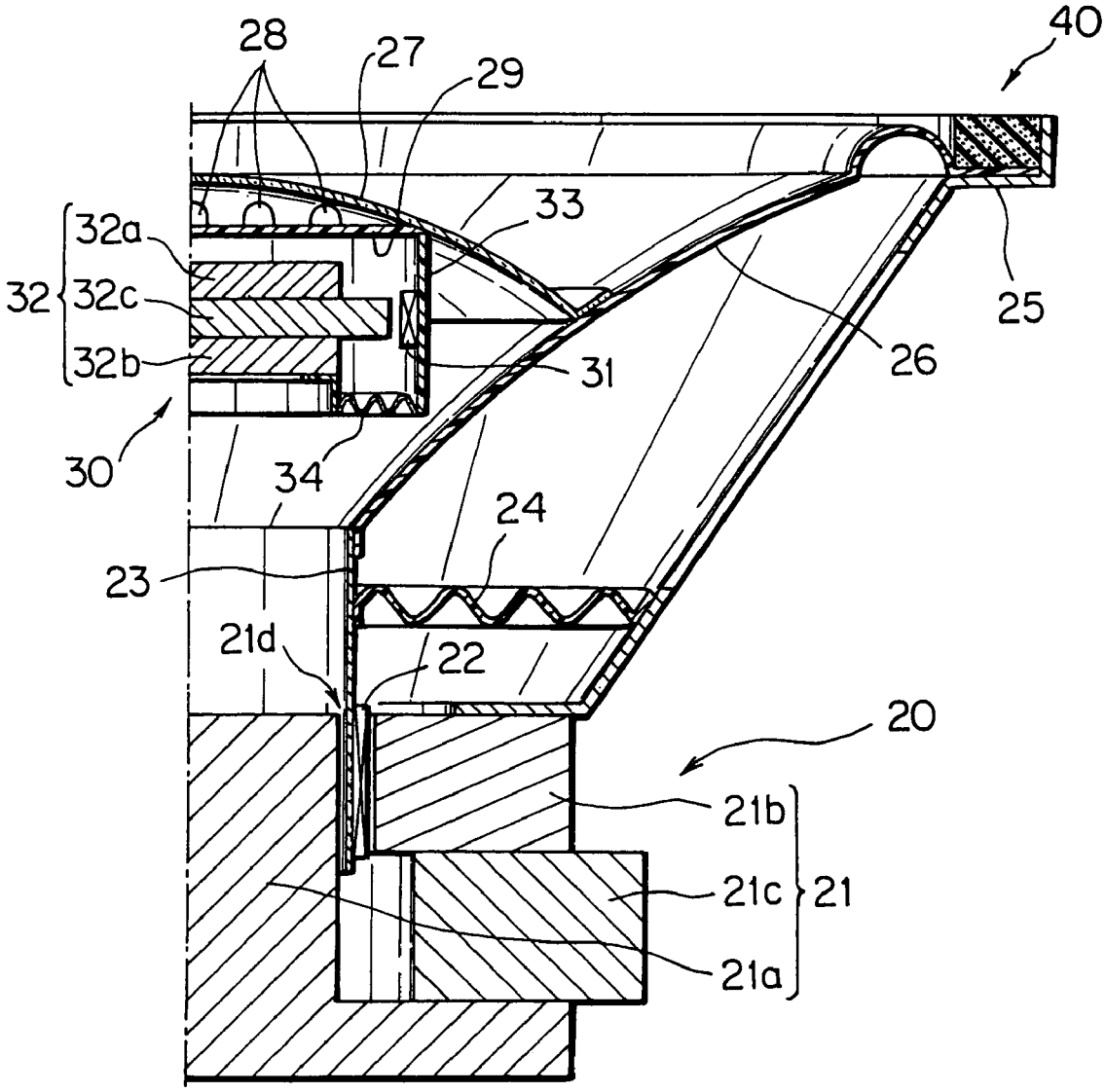
FIG. 2 is a half-sectional schematic view showing an embodiment of a speaker apparatus according to the present invention.
Figure 3:
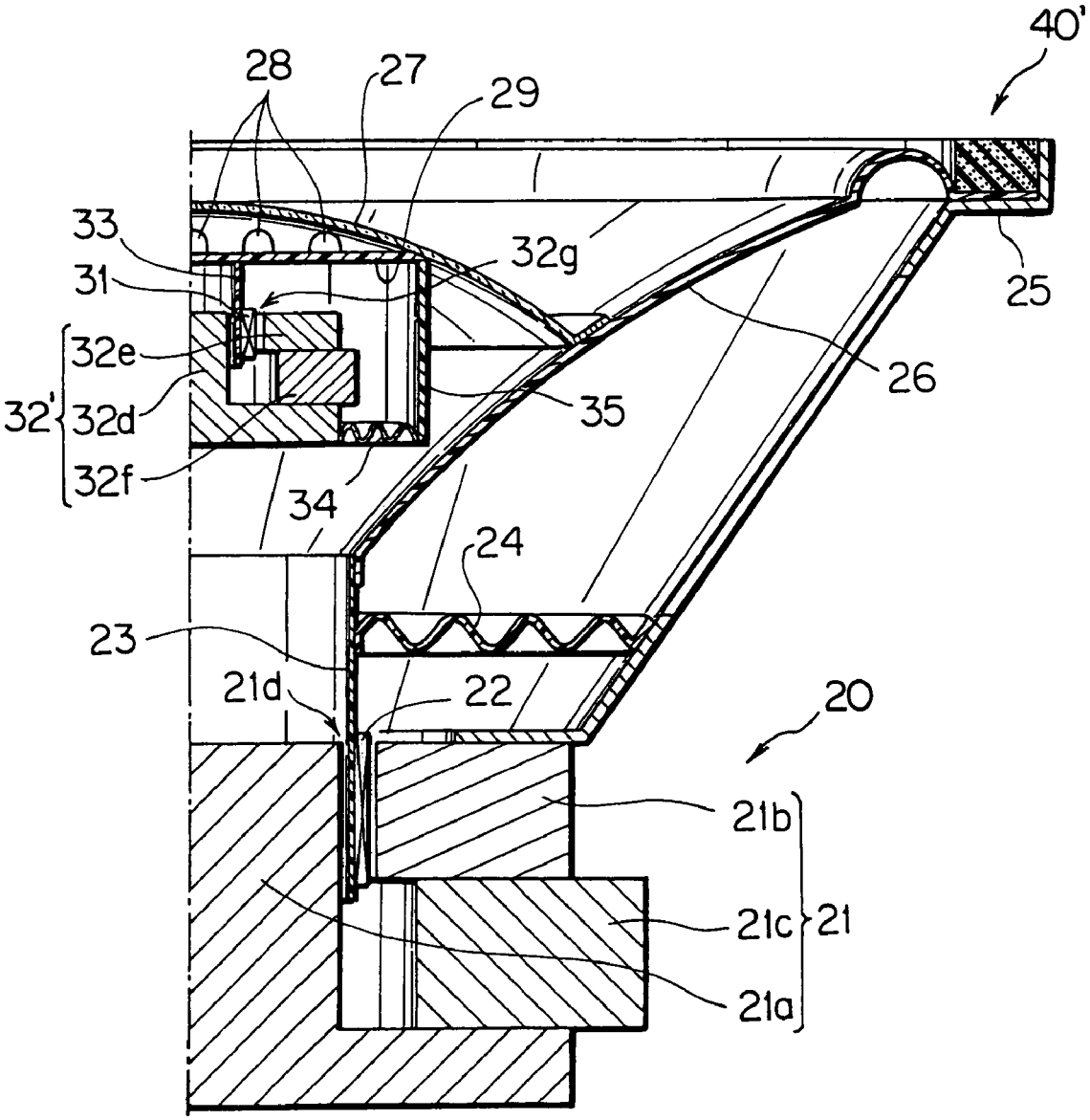
FIG. 3 is a half-sectional schematic view showing another configuration of the embodiment of the speaker apparatus according to the present invention.
Figure 4:
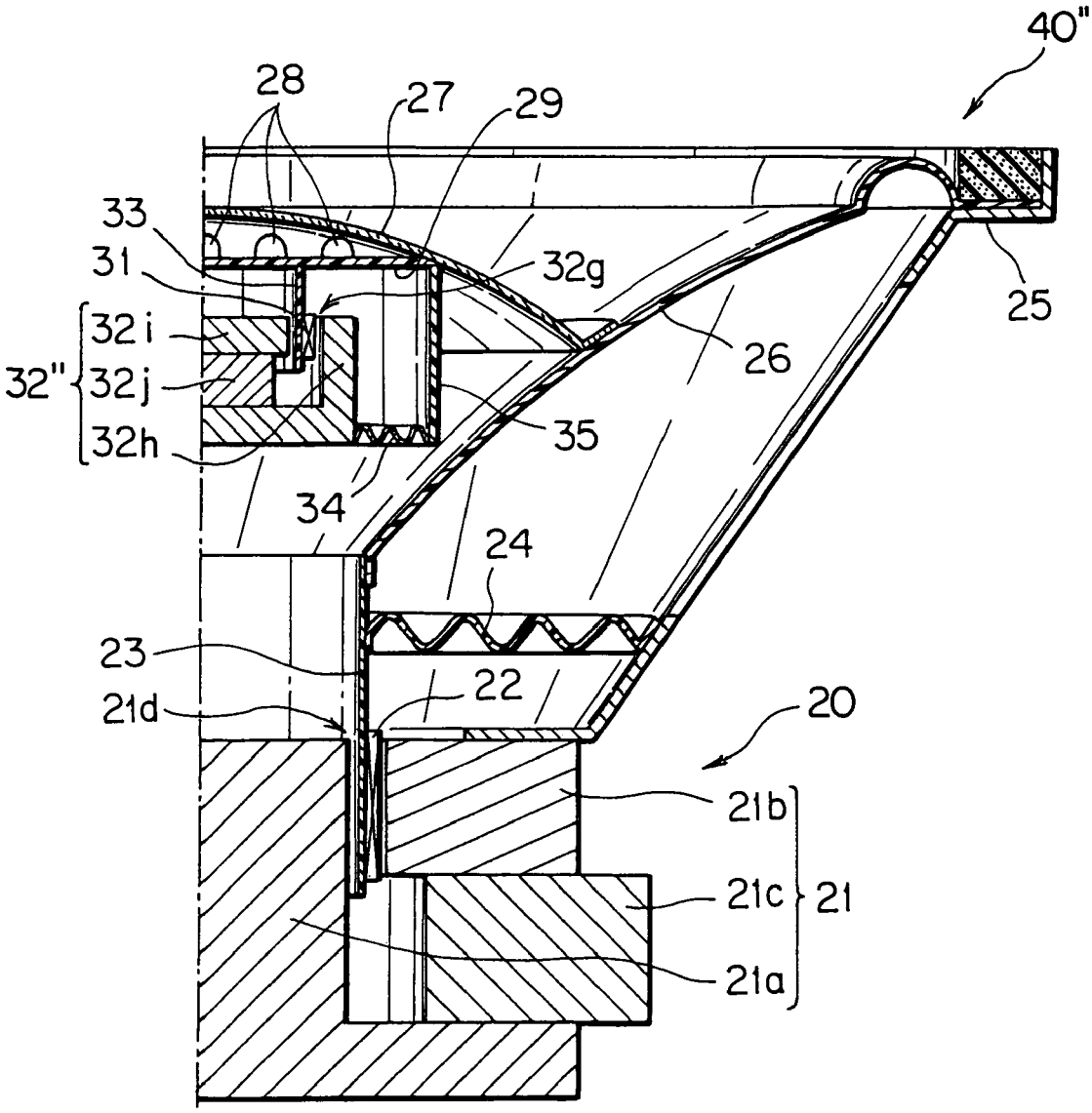
FIG. 4 is a half-sectional schematic view showing another configuration of the embodiment of the speaker apparatus according to the present invention.

The embodiment of a speaker apparatus 40 according to this invention will be explained with reference to FIGS. 2 through 4. In a speaker apparatus 40 shown in FIG. 2, an external magnetic driving circuit 21 having a ring-shaped magnetic gap 21*d* includes a cylindrical center pole 21*a*, a yoke 21*b*, and a magnet 21*c* positioned in the vicinity of the yoke 21*b*. A voice coil 22 is inserted into the magnetic gap 21*d*. A drive unit 20 includes the magnetic driving circuit 21 and the voice coil 22. The voice coil 22 is wound around an outer periphery of a cylindrical coil bobbin 23. The cylindrical coil bobbin 23 is coupled to a frame 25 through a damper 24. The damper 24 supports the voice coil 22 movably in a vertical direction.

Further, an inner periphery of a diaphragm 26 having a ring shape in a top view adheres to an outer periphery of the coil bobbin 23. An outer periphery of the diaphragm 26 is fixed on the frame 25. A dome-shaped center cap 27 covers a center hole of the diaphragm 26. A substrate 29 on which LEDs 28 as light-emitting devices are mounted, and an electromotive force generator 30 for lighting the LEDs 28 are attached to a back surface of the center cap 27.

The electromotive force generator 30 includes an induction coil 31 for generating the electromotive force, and a magnetic lighting circuit 32 for providing a magnetic field to the induction coil 31. The magnetic lighting circuit 32 is a repulsion-type magnetic circuit, and includes magnets 32*a*, 32*b* arranged upward and downward, and a center plate 32*c* arranged between the magnets 32*a* and 32*b*. The induction coil 31 is fixed on the center cap 27 through a coil bobbin 33 around which the induction coil 31 is wound. The magnetic lighting circuit 32 is coupled to the center cap 27 through the coil bobbin 33 and a damper 34 as a coupler. The magnetic lighting circuit 32 is coupled to the center cap 27 movable relative to the center cap 27 by the damper 34.

According to the above, when the input current supplied to the voice coil 22 is displaced, the coil bobbin 23 oscillates up and down, and the diaphragm 26 and the center cap 27 oscillate to generate a sound. Further, owing to the oscillation of the center cap 27, the induction coil 31 fixed on the center cap 27 also oscillates. On the other hand, the magnetic lighting circuit 32 coupled to the center cap 27 through the damper 34 oscillates with a delay in comparison to the oscillation of the center cap 27.

Accordingly, a relative position between the induction coil 31 and the magnetic lighting circuit 32 is changed, and a magnetic flux through the induction coil 31 is changed. Thus, the induction coil 31 induces the electromotive force to light the LEDs 28. In addition, a front surface of the center cap 27 in front of the LEDs 28 has an opening or is made of transparent material, so that the LEDs 28 can be seen from the front surface of the center cap 27.

According to this embodiment, the magnetic lighting circuit 32 corresponding to the induction coil 31 for generating the electromotive force to light the LEDs 28 is mounted on the speaker apparatus 40, separated from the magnetic driving circuit 21. Therefore, the one magnetic circuit 21 is not required to provide magnetic fields to the two of the voice coil 22 and the induction coil 31. Therefore, high magnetic fields can be respectively provided to the voice coil 22 and the induction coil 31. Further, it is not necessary to insert the two coils 22, 31 into the one magnetic gap 21*d*. Thus, the speaker apparatus 40 can be assembled more easily, and a production cost of the speaker apparatus 40 can be reduced.

Further, according to this embodiment, the LEDs 28, the induction coil 31, and the magnetic lighting circuit 32 are attached to the center cap 27. This structure allows to assemble the speaker apparatus 40 on a production line with the center cap 27 to which the induction coil 31 and the magnetic lighting circuit 32 are attached, while the induction coil 31 is held in a magnetic flux loop of the magnetic lighting circuit 32. Thus, it is not necessary to mount the induction coil 31 on the magnetic lighting circuit 32 in this production line. Further, it is possible to assemble the speaker apparatus 40 with the center cap 27 to which the induction coil 31 and the LEDs 28 are attached after the induction coil 31 and the LED 28 are wired to each other. Since wiring the induction coil 31 to the LED 28 is not necessary, man-hours in the speaker apparatus 40 production line and the production cost of the speaker apparatus 40 can be reduced.

Further, according to this embodiment, since the induction coil 31 is fixed on the center cap 27, and the magnetic lighting circuit 32 is coupled to the center cap 27 through the damper 34, an oscillation of the center cap 27 generates the electromotive force in the induction coil 31. Further, since the LEDs 28 are mounted on the center cap 27, visibility of the LEDs 28 can be improved.

In the embodiment described above, the repulsion-type magnetic circuit is used as the magnetic lighting circuit 32. However, as another configuration of the embodiment shown in FIG. 3, an external magnetic circuit 32' having a center pole 32*d*, a yoke 32*e*, a magnet 32*f* positioned in the vicinity of the yoke 32*e* can be used. Further, as another configuration of the embodiment shown in FIG. 4, an internal magnetic circuit 32" having a center pole 32*h*, a yoke 32*i*, and a magnet 32*j* positioned in the vicinity of the center pole 32*h* also can be used. In each speaker apparatus 40, 40' 40", the induction coil 31 is fixed on the center cap 27 in a manner that the induction coil 31 is arranged in a magnetic gap 32*g*. Further, in each speaker apparatus 40, 40', 40", each of the magnetic lighting circuits 32, 32', 32" is coupled to the center cap 27 through the damper 34 and a fixing member 35 fixed on the center cap 27.

In this embodiment described above, both of the induction coil 31 and the magnetic lighting circuit 32 are attached to the center cap 27. However, the induction coil 31 and the magnetic lighting circuit 32 may be attached to different areas respectively, and then assembled together on the speaker apparatus 40, 40', 40" assembly line. Because as long as the magnetic lighting circuit 32 is mounted separately from the magnetic driving circuit 21, a high magnetic field can be provided to both of the voice coil 22 and the induction coil 31 like the embodiment described above. Further, in this case, the speaker apparatus 40, 40', 40" can be assembled more easily, and the production cost of the speaker apparatus 40, 40', 40" can be reduced.

Further, the induction coil 31 and the magnetic lighting circuit 32 are not limited to be attached to the center cap 27, and can be attached to anywhere as long as it oscillates owing to the drive unit 20. For example, the induction coil 31 and the magnetic lighting circuit 32 may be attached to the diaphragm 26.

According to the embodiment described above, the induction coil 31 is fixed on the center cap 27 that oscillates, and the magnetic lighting circuit 32 is coupled to the center cap 27 through the damper 34. However, the magnetic lighting circuit 32 may be fixed to the center cap 27 that oscillates, and the induction coil 31 may be coupled to the center cap 27 through the damper 34.

According to the embodiment described above, both of the induction coil 31 and the LEDs 28 are attached to the center cap 27. However, the induction coil 31 and the LEDs 28 may be attached to different areas respectively, and then wired together on the speaker apparatus assembly line.

According to the embodiment described above, a dome-type center cap is used for the center cap 27. However, the shape of the center cap 27 is not limited to this.

Further, the LEDs 28 are not limited to be attached to the back surface of the center cap 27. The LEDs 28 may be attached to a front surface of the center cap 27, the diaphragm 26, the center pole 21*a*, a gasket, other member that oscillates, other magnetic circuit, and the like.

Having now fully described the invention, it will be apparent to one of ordinary skill in the art that many changes and modifications can be made thereto without departing from the scope of the invention as set forth herein.

What is claimed is:

1. A speaker apparatus comprising:

an oscillation unit for generating a sound;

a drive unit having a voice coil and a magnetic driving circuit for providing a magnetic field to the voice coil to oscillate the oscillation unit;

light-emitting devices mounted on specific positions; and an electromotive force generator for lighting the light-emitting devices including an induction coil and a magnetic lighting circuit, said magnetic lighting circuit being mounted separately from the magnetic driving circuit for providing a magnetic field to the induction coil, whereby owing to an oscillation of the oscillation unit, the induction coil of the electromotive force generator generates an electromotive force for lighting the light-emitting devices.

2. The speaker apparatus as claimed in claim 1, wherein the induction coil and the magnetic lighting circuit are mounted on the oscillation unit.

3. The speaker apparatus as claimed in claim 2, wherein the induction coil and the magnetic lighting circuit are mounted on a center cap of the oscillation unit.

4. The speaker apparatus as claimed in claim 2 or 3, wherein the electromotive force generator further comprises a damper for coupling either one of the induction coil or the magnetic lighting circuit to the oscillation unit movably relative to the oscillation unit, while the other one of the induction coil or the magnetic lighting circuit is fixed on the oscillation unit.

5. The speaker apparatus as claimed in claim 1, wherein the light-emitting devices are attached to a substrate on which the induction coil is mounted.

6. The speaker apparatus as claimed in claim 1, wherein the light-emitting devices are attached to the center cap of the oscillation unit.

* * * * *